United States Patent [19]

Fox

[11] 3,947,132

[45] Mar. 30, 1976

[54] FINGER TIP WRITING INSTRUMENT

[76] Inventor: Joseph Fox, 307 Tomahawk Ave., Black Mountain, N.C. 28711

[22] Filed: Jan. 31, 1975

[21] Appl. No.: 546,134

Related U.S. Application Data

[63] Continuation-in-part of Ser. No. 502,872, Sept. 3, 1974, abandoned.

[52] U.S. Cl. ..... 401/7

[51] Int. Cl.[2] ..... B43K 23/00

[58] Field of Search ..... 401/6–8; 15/227

[56] References Cited

UNITED STATES PATENTS

| | | | |
|---|---|---|---|
| 372,903 | 11/1887 | Forster | 401/7 |
| 504,918 | 9/1893 | Geissinger | 401/7 |
| 684,685 | 10/1901 | Gerst | 401/7 |
| 2,509,837 | 5/1950 | Niizawa | 401/7 |
| 2,989,807 | 6/1961 | Florence | 401/7 X |
| 3,597,099 | 8/1971 | Tollin et al. | 401/7 |

FOREIGN PATENTS OR APPLICATIONS

| | | | |
|---|---|---|---|
| 1,253,519 | 11/1971 | United Kingdom | 401/7 |
| 398,919 | 9/1933 | United Kingdom | 15/227 |
| 544,720 | 4/1942 | United Kingdom | 15/227 |

*Primary Examiner*—Lawrence Charles
*Attorney, Agent, or Firm*—Melville, Strasser, Foster & Hoffman

[57] ABSTRACT

The application discloses a writing instrument adapted to be worn on a forefinger, thereby allowing the user of the instrument to pursue his normal activities without interruptions necessitated by picking up and setting down a writing instrument each time it is needed.

Accordingly, the writing instrument of the present invention includes a holder adapted to fit on the end of a finger and having interior constriction rings enabling the holder to firmly grip normal variations in the forefinger of either an adult male, an adult female or a child.

A substantially conically shaped writing means is firmly affixed to the holder and may be characterized by either an ink or crayon writing capability. In the ink embodiment, the writing means includes a conically shaped ink reservoir having an appropriate writing tip engaging the apex thereof and an air-vented capillary tube to insure uniform ink flow.

15 Claims, 13 Drawing Figures

FINGER TIP WRITING INSTRUMENT

CROSS REFERENCE TO RELATED APPLICATION

This is a continuation-in-part of copending application Ser. No. 502,872 filed Sept. 3, 1974, and now abandoned, in the name of Joseph Fox and bearing the same title as the present application.

BACKGROUND OF THE INVENTION

This invention relates to writing instruments of the type which may be retained on the forefinger of the user, thereby allowing continued use of the writing hand without interruptions necessitated by picking up and setting down a writing instrument each time it is needed.

Of key importance to the success of a finger tip writing instrument is its ability to firmly grip the forefinger of its user. Furthermore, the finger gripping mechanism should be adaptable so as to adequately grip variously sized forefingers. Also of importance is the requirement that the gripping mechanism be comfortable when applied to the forefinger of a user by not putting any appreciable stress thereon. The prior art finger tip writing instruments disclose no gripping mechanisms which simultaneously satisfy the aforementioned requirements. Traditionally, the finger insertion portion of finger tip writing instruments have consisted of thimble type members having solid walls with flattened interior surfaces. If a particular finger conformed to the shape of the thimble, an adequate grip was achieved. However, the thimble arrangement would not adequately grip fingers of other sizes and shapes.

In order to overcome the problems associated with the gripping characteristics of thimble type holders, prior art devices teach the use of holders comprising various clamping means. Although the prior art clamping holders reduce the problems associated with maintaining a firm grip, they become rather uncomfortable after continuous use for a period of time.

The prior art discloses that most proposed finger tip writing instruments were developed for use around the turn of the century. Since, at that time, ball point and felt tip pens had not been adequately developed, the prior art devices are generally limited to fountain pen type instruments. Furthermore, the prior art does not appear to disclose a finger tip writing instrument characterized by a crayon writing capability adapted for use by small children.

A significant deficiency in prior art fountain pen type instruments is that, for the most part, their ink retention capabilities are negligible. Some prior art finger tip writing instruments attempted to increase their ink retaining capabilities by the inclusion of ink reservoirs in the form of hollow walls in the body of the instrument. Although the ink retention capabilities were thereby increased, the difficulties associated with inexpensively manufacturing body members with hollow walls presented problems.

In order to carry an adequate ink supply, present day ball point pens provide a long thin tube as an ink reservoir. However, due to their relatively long length, tube type ink reservoirs would be completely inadequate with respect to a finger tip writing instrument.

SUMMARY OF THE INVENTION

It is an object of the present invention to provide a finger tip writing instrument having a holder means capable of firmly gripping the forefinger of either an adult male, an adult female or a child, including normal variations therein.

It is another object of the present invention to provide a finger tip writing instrument capable of retaining an adequate supply of ink and which can be easily and inexpensively manufactured. More specifically, it is an object of the present invention to provide a ball point finger tip writing instrument having an ink reservoir comparable in volume to ink reservoirs of conventional ball point pens and which can be easily and inexpensively manufactured.

It is still a further object of the present invention to provide a finger tip writing instrument fabricated in whole or in part from crayon wax and especially adapted for use by small children.

In accordance with these and other useful objects, there is provided a finger tip writing instrument having a conically shaped finger retention means adapted to fit onto and firmly grip the forefinger, including normal variations therein, of either an adult male, an adult female, or a child. The conically shaped finger retention means includes an open substantially circular finger inlet end and a smaller truncated end exhibiting a substantially flat exterior and a rounded interior. Gripping capabilities are enhanced by two concentric constriction rings circumferentially protruding from the interior surface of the finger retention means.

A fastening member, secured to the flat exterior of the finger retention means truncated end, may be provided to facilitate the engagement of an appropriate writing means thereto. The writing means may comprise either an ink or a crayon embodiment.

In the ink embodiment, the fastening member comprises a disc structure having a smaller outer circumference than the truncated end of the finger retention means and fixedly engaged to the truncated end thereof. The disc member includes an L-shaped capillary tube having one axis in axial alignment therewith and slightly protruding from the side of the disc opposite the finger retention means. The remaining axis of the L-shaped capillary tube extends radially through the disc member and terminates in a hole in the rim thereof. A key lug is situated on the rim of the disc member and in communication with the truncated end of the conically shaped finger retention means to insure proper orientation of the parts.

In communication with the finger retention means and the disc member is a substantially conically shaped ink reservoir capable of retaining a quantity of ink comparable to that of conventional ball point pen tube-type ink reservoirs. The base portion of the ink reservoir terminates in a ring structure of substantially uniform diameter. The ring structure includes a vent hole extending radially therethrough and an indented key receptacle configured so as to mate with the aforementioned key lug. The vent hole and key receptacle are positioned on the ring structure so as to cause the vent hole to be in alignment with the hole in the disc member when the ink reservoir and finger retention menas are joined together. The conical portion of the ink reservoir extending from the ring structure is provided with an increased inside diameter so as to form a ledge at its juncture with the ring structure. Upon joining the finger retention means with the ink reservoir this ledge mates with the outside end of the disc member while the ring structure mates with the truncated end of the finger retention means.

An appropriate writing tip engages the conical portion of the ink reservoir at its apex. Thereupon, when the conical portion of the ink reservoir is filled with ink, the writing tip will be in communication therewith. To insure that a uniform ink flow is provided, the portion of the L-shaped capillary tube protruding from the disc member is immersed within the ink supply, the former being in communication with atmospheric pressure through the remaining leg of the L-shaped capillary tube, the hole in the disc member and the vent hole in the ring structure.

DESCRIPTION OF THE PREFERRED EMBODIMENTS

Figure 1:
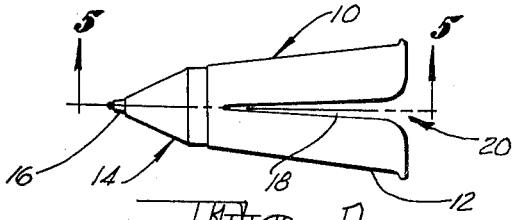
FIG. 1 is a front elevational view of the ink embodiment of the fingertip writing instrument of the present invention.

Referring now to the drawings, FIGS. 1 through 8 depict the ink embodiment of the finger tip writing instrument of the present invention. As best noted in FIG. 1, the finger tip writing instrument 10 comprises a conically shaped holder means 12, a substantially conically shaped ink reservoir 14 and a writing tip 16. Two V-shaped slots 18 and 18*a* (slot 18 only being shown in FIG. 1) are provided in holder means 12. Slots 18 and 18*a* permit a somewhat more comfortable gripping action by the holder means 12 when a finger is inserted into the opened end 20 thereof.

The writing tip 16 can be of any standard variety, such as a standard brass writing tip with a 1 millimeter ball swedged therein. The conical ink reservoir 14 functions to retain a supply of ink and to uniformly supply the ink to the writing tip 16. A detailed description of the conical ink reservoir 14 and its manner of operation will be provided hereinafter.

Figure 2:
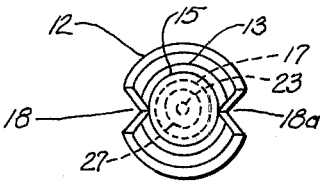
FIG. 2 is a side elevation view of the fingertip writing instrument shown in FIG. 1 looking from the right.
Figure 3:
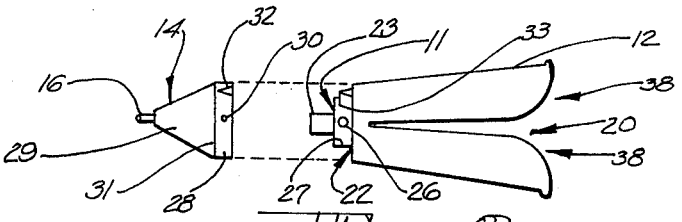
FIG. 3 is a partially exploded front elevational view of the finger tip writing instrument shown in FIG. 1 including a modified finger inlet end.
Figure 4:
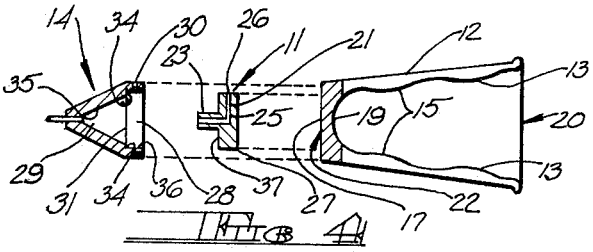
FIG. 4 is an exploded front elevation view, in cross-section, of the finger tip writing instrument shown in FIG. 1, taken along line 5—5.
Figure 5:
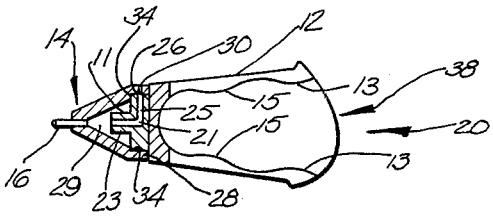
FIG. 5 is a front elevation view, in cross-section, of the finger tip writing instrument shown in FIG. 1, taken along 5—5 including a modified finger inlet end.
Figure 6:
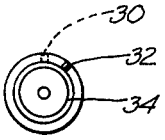
FIG. 6 is a side elevation view of the conically shaped ink reservoir of the ink embodiment of the finger tip writing instrument of the present invention as seen from the right side in FIG. 4.
Figure 7:
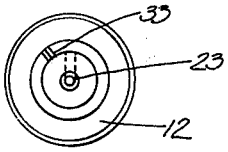
FIG. 7 is a side elevation view of the conically shaped finger retention means of the finger tip writing instrument of the present invention as seen from the left side in FIG. 4.

As most clearly shown in FIGS. 3, 4 and 5, the finger tip writing instrument 10 of the present invention is actually composed of 3 major sections, namely; a conically shaped ink reservoir 14, a disc member 11 including an L-shaped capillary tube 21 and a conically shaped holder means 12. As indicated previously, the main function of the conically shaped holder means 12 is to provide a facility for the insertion of a forefinger into the instrument 10. Accordingly, the conically shaped holder means 12 includes a circular finger inlet end 20 adapted to receive a user's forefinger. As shown most clearly in FIG. 4, the truncated end 22 of the holder means 12 exhibits a flattened exterior 17 and a substantially rounded interior 19. Furthermore, it is to be noted that as shown in FIG. 2, the interior of the holder means 12 includes two protruding constriction rings 13 and 15. The purpose of the constriction rings 13 and 15 and of the rounded interior section 19 is to provide a firm grip on the finger of a user of the writing instrument 10 whether that user be an adult male, an adult female or a child. A more detailed description of the ability of the holder means 12, through the action of the constriction rings 13 and 15 to firmly grip forefingers of varying sizes is provided hereinafter. As mentioned previously, slots 18 and 18*a* are provided in the holder means 12 for purposes of comfort.

As shown most clearly in FIG. 3, a disc member 11, of smaller outer circumference than the truncated end 22 of the holder means 12, is fixedly engaged to truncated end 22. An L-shaped capillary tube, as generally shown at 21, is in direct communication with the disc member 11. Axis 23 of the L-shaped capillary tube 21 is in axial alignment with the disc member 11 and extends partially therethrough. The remaining axis 25 of the L-shaped capillary tube 21 extends radially through the disc member 11 terminating in a hole 26 in the rim 27 thereof.

The remaining portion of the fingertip writing instrument 10 consists of a substantially conically shaped ink reservoir 14. The ink reservoir 14 consists of two sections, a ring structure section 28 and a conical ink retaining means 29. The ring structure 28, extending from the base 31 of conical ink retaining means 29, includes a vent hole 30 extending therethrough. The vent hole 30, which is of smaller diameter than hole 26 in the rim 27 of disc member 11, aligns with hole 26 upon the assembly of the various sections of fingertip writing instrument 10 as shown in FIG. 5.

To insure proper alignment of the vent hole 30 with the hole 26, key means 32 and 33 are provided. As noted in FIGS. 3, 6 and 7, key means 33 comprises a key lug which extends from the truncated end 22 of holder means 12 and is in communication with the rim 27 of the disc member 11. Key means 32 is a corresponding key receptacle notched from the ring structure 28 and adapted to mate with the key lug 33.

As best noted in FIGS. 4 and 5, the interior surface 35 of conical ink retaining means 29 is of reduced diameter with respect to the corresponding interior surface 36 of the ring structure 28. Due to this diameter variation a circular ledge 34 is formed at the juncture of the conical ink retaining means 29 and the ring structure 28. The ledge 34 allows for a good seal to be formed at the base of the ink retaining means 29 thereby reducing any problems regarding ink leakage.

As best seen in FIG. 5, upon assembly of the various sections of the fingertip writing instrument i.e., the holder means 12, the disc member 11 including capillary tube 21 and the ink reservoir 14, the disc member 11 is affixed to the truncated end 22 of the holder means 12. Similarly, the ink reservoir 14 is affixed to the disc member 11 and the holder means 12 whereby the inside surface 36 of the ring structure 28 tightly embraces the rim 27 of the disc member 11 and, the ledge 34, at the base 31 of conical ink retaining means 29, abuts one end 37 of the disc member 11. The key lug 33 and the key receptacle 32 cause the disc member 11 and the ink reservoir 14 to align in a manner such that the vent hole 30 is in alignment with the hole 26. Since, axis 23 of the L-shaped capillary tube 21 extends through the ring structure 28 and into the conical ink retaining means 29, a passage, extending from conical ink retaining means 29 and through axis 23 and 25 of the L-shaped capillary tube 21, is created from the ink supply to the outside air. This passage keeps the ink supply in the conical ink retaining means 29 under atmospheric pressure and insures a proper and uniform ink flow through the writing tip 16 located in the apex of the conical ink retaining means 29.

The unique combination of the conically shaped ink retaining means 29 and the action provided by the L-shaped capillary tube 21 along with hole 26 and vent hole 30 permit the finger tip writing instrument 10 to retain a supply of ink comparable to that contained in conventional thin tube reservoirs while, at the same time, insuring a uniform ink flow. It is to be noted that, if a vent hole were included in the structure of the conically shaped ink retaining means 29, comparable to vent holes in tube reservoirs, the mass of ink would ordinarily force its way therethrough. However, in the case of the L-shaped capillary tube 21, the mass of ink is unable to force its way therethrough. The viscous ink will be forced part way up axis 23 of the capillary tube 21 to a point of balance between the pressure of the mass of ink and the viscosity of the ink. As the vent hole 30 is smaller than the hole 26 in the rim 27 of disc member 11 this will further insure that the no leakage of ink occurs.

Figure 8:
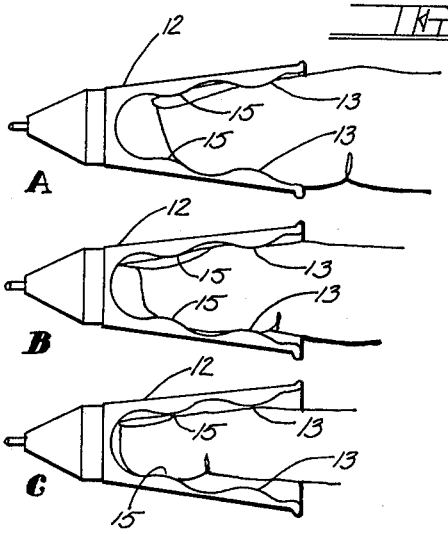
FIG. 8 diagramatically shows the insertion of the forefinger of an adult male, an adult female and a child into the fingertip writing instrument of the present invention.

FIG. 8 diagramatically shows the gripping action of the holder 12 with respect to three forefingers of different size and shape, namely; that of an adult male, an adult female and a child. As will be noted and, as previously mentioned, the conically shaped interior surface of the holder 12 along the constriction rings 13 and 15 function to provide a gripping force which will comfortably retain normal variations in finger size and shape. For example, FIG. 8A shows the forefinger of a typical adult male inserted into the holder 12. In this case, due to the size of the finger, it only partially penetrates the holder 12 and therefor, most of the gripping force is applied by constriction ring 13. On the other hand, in the case of an adult female (see FIG. 8B), penetration into the holder 12 is somewhat deeper, both constriction rings 13 and 15 providing gripping force. Finally, it will be noted (see FIG. 8C) that in the case of a child, penetration of the forefinger into the holder means 12 is substantially complete. In this latter case, most of the gripping force is provided by constriction ring 15.

It is therefore seen that through the action of the constriction rings 13 and 15 a firm grip may be provided on fingers of varying sizes. Furthermore, the rounded profiles of the constriction rings 13 and 15, the conical shape of the holder 12 and the slots 18 and 18*a*, besides achieving a firm grip, also maintain a conformable fit.

It has been found that due to the excellent gripping characteristics of the holder 12 and to the ease by which writing may be accomplished utilizing the writing instrument of the present invention, its use is ideally suited for small children who frequently encounter, as the result of a lack of sufficient manual dexterity, considerable difficulty in manipulating most elongated tubular instruments. These factors coupled with the desire of small children for drawing with crayons, has resulted in the crayon embodiments of the fingertip writing instrument of the present invention shown in FIGS. 9 through 13.

Figure 9:
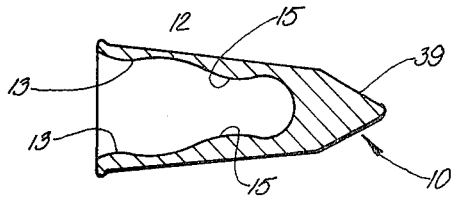
FIG. 9 is a front elevational view, in cross-section, of a crayon embodiment of the fingertip writing instrument of the present invention.

As will be noted from the drawings, the various crayon embodiments all include the holder 12, as previously described herein, as a common element. Accordingly, the constriction rings 13 and 15 serve to firmly and comfortably maintain the writing instrument on a child's finger. FIG. 9 illustrates one crayon embodiment wherein the instrument 10 is a unitary structure molded entirely of crayon wax. That is, both the holder 12 and the writing means 39 are cast as a single structure. The embodiment shown in FIG. 9 is inexpensively and easily manufactured but, due to the frangible nature of thinly molded crayon wax, it is necessary to mold the body of this instrument substantially thicker than the other crayon embodiments described herein.

Figure 10:
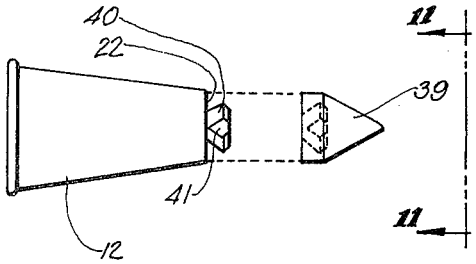
FIG. 10 is an exploded front elevational view of another crayon embodiment of the finger tip writing instrument of the present invention.
Figure 11:
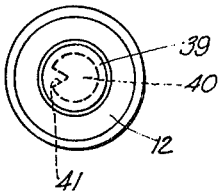
FIG. 11 is a side elevation view of the finger tip writing instrument shown in FIG. 10, taken along line 11—11.

Another crayon embodiment is shown in FIGS. 10 and 11. In this embodiment, the holder means 12 may be molded of plastic and includes, projecting from the truncated end 22 thereof, an undercut button structure 40. The undercut button structure 40 facilitates fastening of the writing means 39 which, in this embodiment, comprehends firmly molding a tip of crayon material thereover. Additionally, a longitudinal notch 41 is provided in the undercut button structure 40 to prevent the molded crayon tip 39 from rotating should it become loosened during use.

Figure 12:
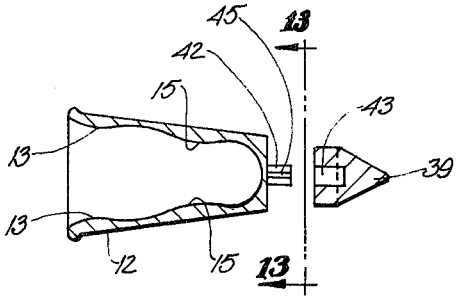
FIG. 12 is an exploded front elevation view, in cross-section, of a final crayon embodiment of the finger tip writing instrument of the present invention.
Figure 13:
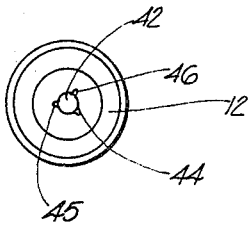
FIG. 13 is a side elevation view of the finger tip writing instrument shown in FIG. 12, taken along line 13—13.

A final crayon embodiment is illustrated in FIGS. 12 and 13. The holder 13, fabricated again of a non-breakable plastic material, is provided with a stem 42 having substantially the same diameter as a corresponding hole 43 in the molded crayon tip 39. The stem 42 is provided with a plurality of axially extending ribs 44, 45 and 46 which, upon insertion of the stem 42 into the hole 43, force their way into the wax material of the crayon tip 39, thereby holding the tip 39 firmly in place. The instrument of this embodiment is especially adapted for use with interchangeable crayon tips 39 of different colors.

It will, of course, be understood that the descriptions herein of the preferred embodiments of the invention are intended as exemplary only and not to impose any limitations on the invention. For example, the finger inlet end 20 of the holder means 12 may be configured so as to exhibit a humped shape, as generally indicated at 38 in FIGS. 3 and 5, wherein the instrument 10 could not assume an upright orientation when not in use. In the ink embodiment of the present invention, this would prevent the supply of ink in the ink reservoir 14 from gravitating to the base 31 thereof and causing poor ink flow upon the resumption of use of the instrument 10. Also, the disc member 11 and the holder means 12, for manufacturing purposes may be molded as a single unit, the key means 32 and 33 may be otherwise configured, interchangeable writing tips of various types may be utilized and the slots 18 and 18*a* may be configured otherwise than as shown or, even omitted entirely.

The embodiments of the invention in which an exclusive property or privilege is claimed are defined as follows:

1. A finger tip writing instrument comprising:

a. a conically shaped holder means adapted to fit on the end of a finger, said holder means having an open finger inlet end and a smaller truncated end, b. a disc-like member having an axially extending tubular element and having a radial hole communicating with said axial tubular element, said tubular element and radial hole together constituting a capillary tube, and c. a substantially conically shaped ink reservoir having a vent hole extending radially therethrough, the apex of said substantially conically shaped ink reservoir engaging a writing tip and, the opposite end thereof being affixed to said holder means such that said tubular element of said disc-like member extends partially therein and said vent hole is in alignment with said radial hole in said disc-like member.

2. The finger tip writing instrument according to claim 1 wherein said finger inlet end of said holder means is substantially circular.

3. The finger tip writing instrument according to claim 1 wherein said truncated end of said holder means has a substantially flat exterior and a rounded interior.

4. The finger tip writing instrument according to claim 1 wherein said disc-like member has a smaller outer circumference than said truncated end of said holder means.

5. The finger tip writing instrument according to claim 1, wherein said substantially conically shaped ink reservoir comprises a conical ink retaining means and a ring structure extending from the base thereof.

6. The finger tip writing instrument according to claim 5, wherein said radial vent hole extends through said ring structure.

7. The finger tip writing instrument according to claim 5, wherein the inside surface of said conical ink retaining means is of reduced diameter with respect to said ring structure, the base of said conical ink retaining means forming, at its juncture with said ring structure, a ledge, whereby said ink reservoir is affixed to said disc-like member and said holder means such that:

1. the inside surface of said ring structure mates with the rim of said disc-like member,
2. said ledge abuts the end of said disc-like member having said axially extending tubular element, and
3. the end of said ring structure opposite said conical ink retaining means abuts said truncated end of said holder means with said radial hole in said disc-like member aligned with said vent hole in said ring structure and said axially extending tubular element of said capillary tube extending through said ring structure and into said conical ink retaining means.

8. A finger tip writing instrument according to claim 1 wherein said holder means includes at least two concentric inwardly projecting constriction rings, said constriction rings adapted to provide gripping forces on variable sized fingers inserted into said holder means.

9. A finger tip writing instrument according to claim 1, where key means are provided to insure proper alignment of said radial hole in said disc-like member with said vent hole in said substantially conically shaped ink reservoir.

10. A finger tip writing instrument according to claim 1, wherein said writing tip is interchangeable.

11. A finger tip writing instrument according to claim 1, wherein said holder means includes at least two substantially V-shaped slots.

12. A finger tip writing instrument according to claim 1, wherein said vent hole is smaller than said radial hole in said disc-like member.

13. A finger tip writing instrument according to claim 1, wherein said finger inlet end of said holder means is humped shaped so as to prevent said finger tip writing instrument from assuming an upright orientation when not in use.

14. A finger tip writing instrument comprising a conically shaped holder means adapted to fit on the end of a finger and having an open finger inlet end and a smaller truncated end, said holder means including at least two concentric inwardly projecting constriction rings, said constriction rings adapted to provide gripping forces on variable sized fingers inserted into said holder means and a substantially conically shaped writing means engaging said truncated end of said holder means, said holder means and said writing means comprising a unitary structure molded of crayon wax.

15. A finger tip writing instrument comprising:

a. a conically shaped holder means adapted to fit on the end of a finger and having an open finger inlet end and a smaller truncated end, said holder means including at least two concentric inwardly projecting constriction rings adapted to provide gripping forces on variable sized fingers inserted into said holder means;

b. A substantially conically shaped writing means comprising a crayon wax structure, said writing means being characterized by a recessed portion at the base thereof;

c. A fastening member of lesser diameter than and rigidly projecting from said truncated end of said holder means, said fastening member cooperating with said recessed portion of said writing means and including means to non-rotatably secure said writing means to said truncated end of said holder means.

* * * * *